United States Patent [19]

Maeda et al.

[11] Patent Number: 4,596,115

[45] Date of Patent: Jun. 24, 1986

[54] METHOD OF MANUFACTURING TEXTURED YARN

[75] Inventors: Yoshiyasu Maeda, Yamatokouriyama; Fumiaki Nakaji, Kyoto, both of Japan

[73] Assignee: Murata Kikai Kabushiki Kaisha, Japan

[21] Appl. No.: 629,324

[22] Filed: Jul. 10, 1984

[30] Foreign Application Priority Data

Jul. 11, 1983 [JP] Japan ..... 58-126479
Jul. 11, 1983 [JP] Japan ..... 58-126483

[51] Int. Cl.[4] ..... D02G 1/20

[52] U.S. Cl. ..... 57/289; 57/290; 57/351; 57/908

[58] Field of Search ..... 57/336, 289, 290, 350, 57/908

[56] References Cited

U.S. PATENT DOCUMENTS

| | | | |
|---|---|---|---|
| 3,309,855 | 3/1967 | Stoll et al. | 57/289 |
| 3,379,002 | 4/1968 | Rosenstein | 57/350 X |
| 4,047,373 | 9/1977 | Takai | 57/336 |
| 4,070,815 | 1/1978 | Negishi et al. | 57/289 X |
| 4,164,836 | 8/1979 | Tanae et al. | 57/289 X |
| 4,292,799 | 10/1981 | Otaki et al. | 57/289 X |
| 4,442,663 | 4/1984 | Shindo | 57/336 |

*Primary Examiner*—Donald Watkins
*Attorney, Agent, or Firm*—Spensley Horn Jubas & Lubitz

[57] ABSTRACT

A method of and apparatus for manufacturing a textured yarn. The method comprises introducing plural yarns simultaneously in a state out of contact with each other into a belt type false twister including two crossing endless belts travelling in directions from each other and then exerting a compressed fluid on the plural yarns to partially intertwine the yarns. The intertwined yarns are wound up as a single textured yarn.

8 Claims, 15 Drawing Figures

METHOD OF MANUFACTURING TEXTURED YARN

BACKGROUND OF THE INVENTION

1. Field of the Invention

The present invention relates to a method and apparatus for manufacturing a textured yarn from multifilament yarn and more particularly to a method and apparatus for manufacturing a novel textured yarn using what is called a belt type false twister in which false twisting is performed while nipping yarn between two crossing endless belts travelling in directions different from each other.

2. Prior Art

Belt type false twisters have various merits. For example, multifilament yarn (hereinafter referred to simply as "yarn") can be nipped completely between two belts, and since a force acting in a twisting direction and a force in a yarn delivery direction can be simultaneously imparted to the yarn, the twisting efficiency is high, and there can be attained high dyeability and bulkiness, and it is possible to effect a high speed processing. Particularly, it is known that the twisting efficiency is greatly influenced by the thickness of yarn, that is, the finer the yarn denier, the higher the twisting efficiency, and that other characteristics are improved in proportion thereto.

Taking note of the above point, the present inventor hit upon the idea of constituting a textured yarn as the final product from plural fine yarns.

SUMMARY OF THE INVENTION

It is an object of the present invention to provide a novel textured yarn obtained by doubling a plurality of false-twisted fine yarns.

It is another object of the present invention to provide a method of manufacturing a textured yarn by false-twisting fine yarns each independently by the use of a belt type false twister and then doubling the false-twisted yarns into a single yarn.

It is a further object of the present invention to provide a belt type false twisting device and method for false-twisting plural yarns at a time while introducing the yarns simultaneously into a single belt type false twister in the above-mentioned method.

The present invention is characterized by introducing plural yarns simultaneously in a state out of contact with each other into a belt type false twister in which false twisting is performed while nipping the yarns between two crossing endless belts travelling in directions different from each other, then exerting a compressed fluid on the yarns to intertwine the latter and taking up the yarns as a single yarn.

The present invention has also found out false twisting conditions which are considered to be most suitable for the above method of false-twisting plural yarns simultaneously in a single belt type false twister.

BRIEF DESCRIPTION OF THE DRAWINGS

FIGS. 4 to 7 are views of a fluid processing unit, of which

FIG. 4 is an exploded perspective view,

FIG. 5 is a plan view of a block which constitutes the fluid processing unit, and FIGS. 6 and 7 are vertical sections of the fluid processing unit;

DETAILED DESCRIPTION OF THE INVENTION

An embodiment of the present invention will be described hereinunder with reference to the drawings.

Figure 1:
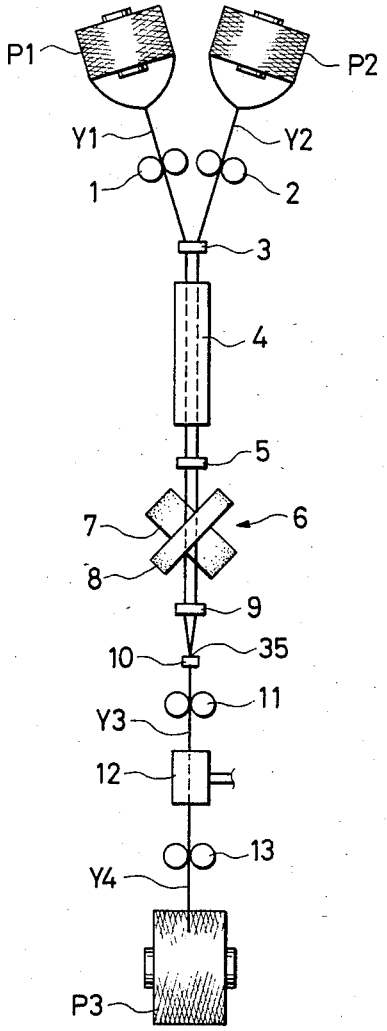
FIG. 1 is a schematic illustration of an apparatus embodying the present invention.

Referring first to FIG. 1, yarns Y1 and Y2 wound round two yarn feed packages P1 and P2 are drawn out separately by means of first feed rollers 1 and 2, then pass through a first yarn guide 3, a heater 4 and a second yarn guide 5 successively and are introduced simultaneously into a false twister 6. The yarns Y1 and Y2 are each composed of filaments of a number corresponding to about half of the number of filaments of the yarn to be finally obtained. The false twister 6 performs false twisting by nipping the yarns Y1 and Y2 between two crossing false twisting belts 7 and 8 travelling in directions different from each other. The twists formed on the yarns Y1 and Y2 by the false twister are propagated to the first feed rollers 1 and 2 and heat-set by the heater 4 to impart bulkiness and elasticity to the yarns Y1 and Y2. The yarns Y1 and Y2 leaving the false twister 6 are then drawn out by second feed rollers 11 through a third yarn guide 9 and a fourth yarn guide 10 and introduced into a fluid processing unit 12, then wound onto a take-up package P3 through third feed rollers 13. While passing through the heater 4 and false twister 6, the yarns Y1 and Y2 are kept out of contact and parallel with each other by the first, second and third yarn guides 3, 5 and 9, then doubled by the fourth yarn guide 10 into a single yarn Y3 apparently and thereafter intertwined by the fluid processing unit 12 into a single yarn Y4 actually.

Figure 2:
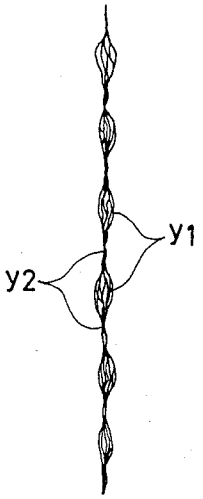
FIG. 2 is a view showing a part of a textured yarn produced according to the present invention.

Since the above false twisting is applied to the yarns Y1 and Y2 each independently, the yarns just after false-twisted are each independent textured yarns and the yarn Y3 obtained by doubling those yarns is in an easily separable state. The yarn Y4 wound up through the fluid processing unit 12 is as a whole a false-twisted, crimped textured yarn as shown in FIG. 2, having a thick yarn portion y1 and an intertwined portion y2 in an alternate fashion. The intertwined portion y2 is a portion in which a multitude of filaments constituting the yarns Y1 and Y2 are intertwined by the action of fluid and in which convergence has been imparted to both yarns Y1 and Y2 into a single yarn Y4. In subsequent steps, particularly in the weaving or knitting step, the presence of the intertwined portion y2 prevents the yarns Y1 and Y2 or filaments from being separated, broken, entwined or fluffed. The intertwined portion y2 will later disappear under the tension acting on the yarn Y4, but the intertwinement of filaments will remain to some extend, which prevents a complete separation of both yarns Y1 and Y2 and maintains their integrality. More particularly, the yarn Y4 after knitting into a knitted product has both integrality as a single yarn Y4 and separateness as two yarns Y1 and Y2. In this state, moreover, both yarns Y1 and Y2 are each a fully crimped novel yarn. Therefore, the knitted or woven product comprising the yarn Y4, as compared with conventional like products, has a larger thickness, superior air permeabiity and warmth keeping property and a unique feeling.

Figure 3:
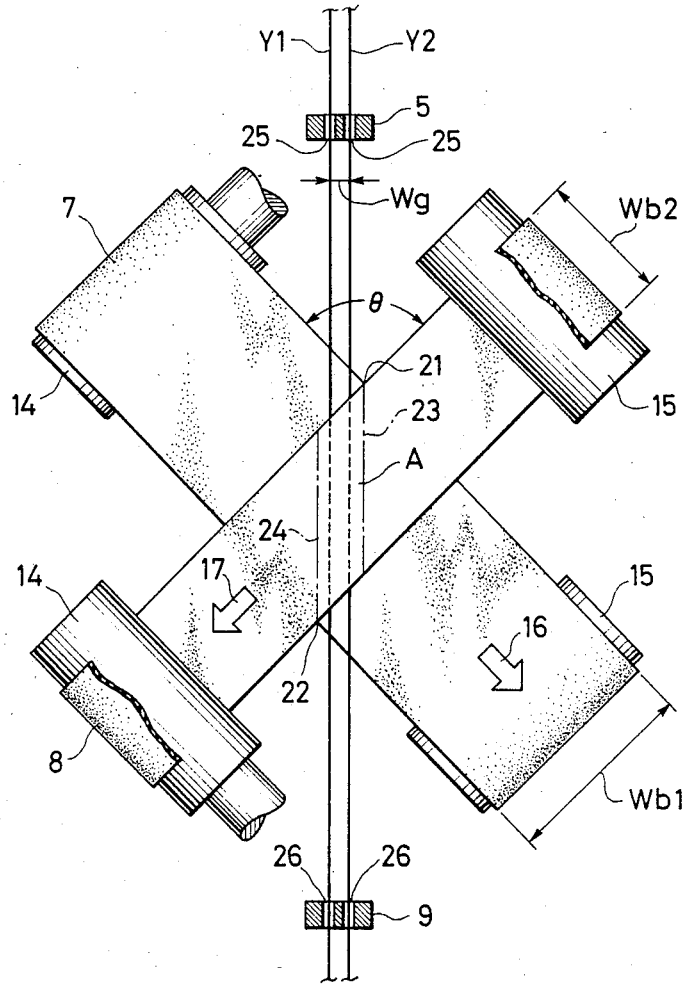
FIG. 3 is a view showing a false twister.
Figure 4:
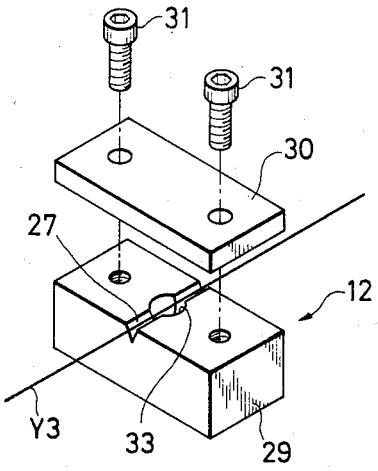
Figure 6:
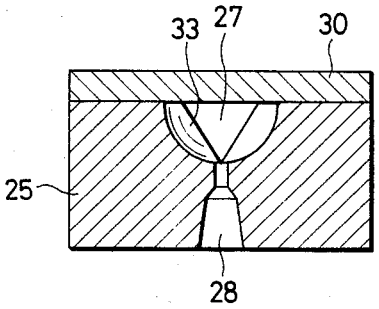
Figure 5:
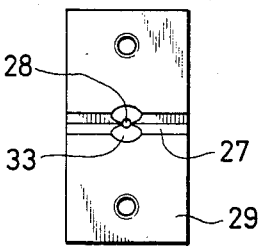
Figure 7:
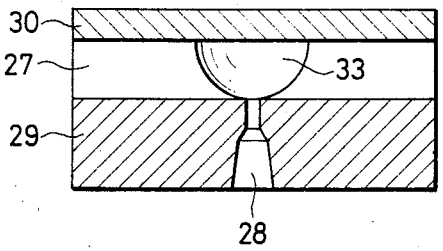

Referring now to FIG. 3, there is shown the structure of the false twister 6, in which the false twisting belts 7 and 8 are endless belts each wound on pulleys 14 and 15 and travelling respectively in the directions of arrows 16 and 17. Their widths Wb1 and Wb2 are different from each other. Therefore, a nip area A surrounded by straight lines 23 and 24 drawn from intersecting points 21 and 23 of side edges of both belts 7 and 8 and parallel to the yarn travelling path, and also by both side edge portions therebetween of the narrower belt 8, is in the form of parallelogram. The yarns Y1 and Y2 are guided in parallel with each other by the second and third yarn guides 5 and 9 so that they pass through the area A in a narrower spacing than that between the straight lines 23 and 24. Therefore, both yarns Y1 and Y2 have the same nip lengths L1 and L2 and are given the same number of twists and drawn out under the same tension. This means that even if the yarns Y1 and Y2 move slightly within the area A, the number of twists and tension will not change and a stable twisting can be applied completely equally to both yarns Y1 and Y2.

To ensure twisting of the yarns Y1 ad Y2, it is necessary to keep the spacing Wg. In other words, contact of the yarns Y1 and Y2 with each other in the nip portion of the belts 7 and 8 leads to lowering of the twisting efficiency as in the case of twisting a single thick yarn and permits an easy occurrence of yarn breakage. To avoid such inconvenience, the second and third yarn guides 5 and 9 are formed with two yarn passing holes 25 and two like holes 26, respectively, to ensure separation of the yarns Y1 and Y2, and preferably these holes 25 and 26 are arranged so that a plane joining the travelling paths of the yarns Y1 and Y2 between the yarn guides 5 and 9 is parallel to the area A of the false twisting belts 7 and 8.

Referring now to FIGS. 4 to 7, there is illustrated the fluid processing unit 12, which is constituted of a block 29 having a yarn passage 27 and a fluid nozzle 28, a cover 30 and screws 31 for assembling the block 29 and the cover 30 integrally with each other. The yarn passage 27 is formed as a groove of V section on the upper surface of the block 29, and the fluid nozzle 28 is formed through the block 29 so as to open to a central bottom portion of the yarn passage 27. The portion surrounding the bottom portion or the opening portion of the fluid nozzle 28 is enlarged to form a generally hemispherical fluid dispersion chamber 33.

The yarn Y3 after doubling in the fourth yarn guide 10 is introduced into the yarn passage 27, and air 34 is injected continuously to the yarn Y3 from the fluid nozzle 28 which is connected to a compressed air source (not shown). In the fluid dispersion chamber 33 the air 34 becomes a rotating air current, which causes the many filaments of the yarn Y3 in the yarn passage 27 to intertwined to form the intertwined portion y2 shown in FIG. 2, and thus the original two yarns Y1 and Y2 are doubled into a single yarn Y4 as previously noted.

The above intertwining treatment applied to the yarn Y3 by the fluid processing unit 12 considerably affects the properties of the yarn Y4 to be produced or knitted or woven product obtained therefrom. More particularly, where the convergence in the intertwined portion y2 is strong, or where the ratio of the length of the intertwined portion y2 to the thick yarn portion y1 is high, the foregoing integrality in the yarn Y4 to be produced is maintained strongly, while in the reverse case the foregoing separation is emphasized, thus resulting in delicately different characteristics in each of the cases. It is therefore preferable that the structure of the fluid processing unit 12 and the flow rate of the air 34 be suitably changed or adjusted according to characteristics required of the yarn Y4 to be produced. The present invention permits such change or adjustment to some extent.

The following description is now provided about a method for producing another novel yarn according to the present invention.

According to this method, the yarns Y1 and Y2 which constitute the yarn Y4 to be produced are of different kinds whereby it is intended to obtain a more unique effect with respect to dyeability, etc. As an example, the yarns Y1 and Y2 have different draw ratios. More particularly, using the same kind of yarns Y1 and Y2, the first feed rollers 1 and 2 are rotated at different peripheral speeds, or the original yarns Y1 and Y2 are already of different draw ratios. As a result, there can be obtained a difference in crimping property and dyeability between both yarns Y1 and Y2, thereby permitting a more unique effect to be exhibited. Also by using different kinds of yarns or yarns different in the number of filaments or in thickness as yarns Y1 and Y2, there can be obtained such various effects as mentioned above, and as the case may be it is also possible to obtain a yarn which assumes an aspect like covering yarn.

According to the present invention, moreover, plural yarns are false-twisted simultaneously by a single belt type false twister. But, in the conventional false twisting method using belts, a change in the yarn nipping position by belts is apt to cause a change in the number of yarn twists and it is not easy to ensure good false twisting conditions. The present invention established the following false twisting conditions considered to be most suitable for the method in which false twisting is performed while introducing plural yarns simultaneously into a single belt type false twister.

In FIG. 3, the false twisting belts 7 and 8 are endless belts each wound round the pulleys 14 and 15 and travelling respectively in the directions of arrows 16 and 17. These belts have different widths Wb1 and Wb2. Therefore, the nip area A surrounded by straight lines 21 and 22 drawn from intersecting points 21 and 22 of side edges of the belts 7 and 8 and parallel to the yarn travelling path, and also by both side edge portions therebetween of the narrower belt 8, is in the form of parallelogram. Two yarn passing holes 25 and two like holes 26 for passing therethrough the yarns Y1 and Y2 formed respectively in the second and third yarn guides 5 and 9 are disposed at the same spacing Wg so that a line joining the centers of the spacings Wg in the second and third yarn guides 5 and 9 passes through the center of the nip area A and also through one yarn passing hole 35 formed in the fourth yarn guide 10. The spacing Wg is so restricted as to permit both yarns Y1 and Y2 to pass together through the nip area A.

As to the widths Wb1 and Wb2 of the false twisting belts 7 and 8, their concrete ranges and grounds therefor will be explained below.

Figure 8:
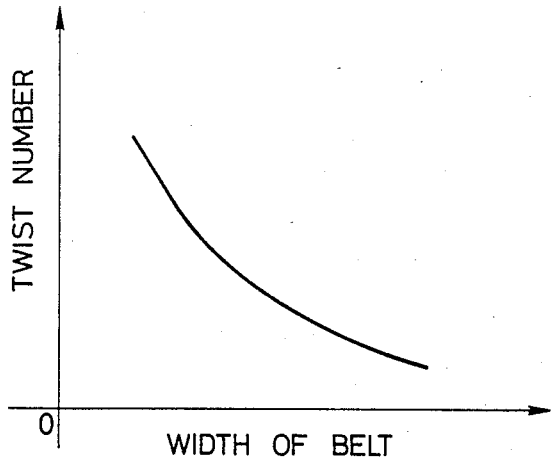
FIGS. 8 and 9 are graphs showing general tendencies respectively on the relation between the belt width and the number of twists and the relation between the dislocation of yarn and the number of twists.
Figure 10:
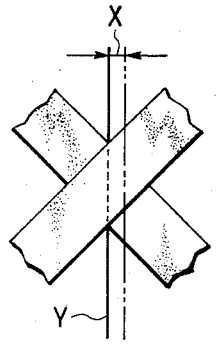
FIG. 10 is a view explanatory of the above dislocation.
Figure 9:
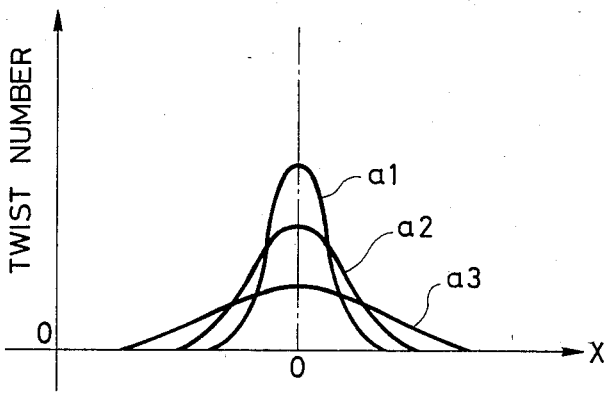

Assuming that the inter-belt contact pressure is constant, the belt width and the number of twists are in such a relation that the narrower the belt width, the larger the number of twists, as shown graphically and schematically in FIG. 8. However, as shown in FIG. 9, it is also known that the narrower the belt width, the less stable becomes the operation. The "stable" or stability means a coefficient of variation of the number of twists in the event of dislocation of yarn Y from its position shown in solid line, i.e., its position passing the center of the nip area, to the right or left by a certain distance X as shown in alternate long and two short dashes line in FIG. 10. In FIG. 9, a1, a2 and a3 represent belt widths, which are in the following relationship: $a1<a2<a3$. Thus, in the use of narrow belts, a slight dislocation causes a large change in the number of twists, and their nip area is inevitably small, so it is difficult to nip yarn stably in the said area, and it is also a fact that such dislocation occurs easily. Moreover, if the belt width is large, the inter-belt contact area increases, which accelerates the belt wear. Further, the power consumption is changed by the difference of the belt width. Thus, there are various factors to be considered in establishing an optimum belt width. A simple representation in terms of a graph or like means is difficult. Having made various experiments, the present inventor reached the conclusion that the belt results were obtained in the case of the width of one belt being in the range of 6 to 10 mm, especially 8 mm. Using two different false twisting belts, false twisting experiments were conducted in which the width of one belt was set at the above size and that of the other belt was varied. The following results could be obtained.

Figure 11A:
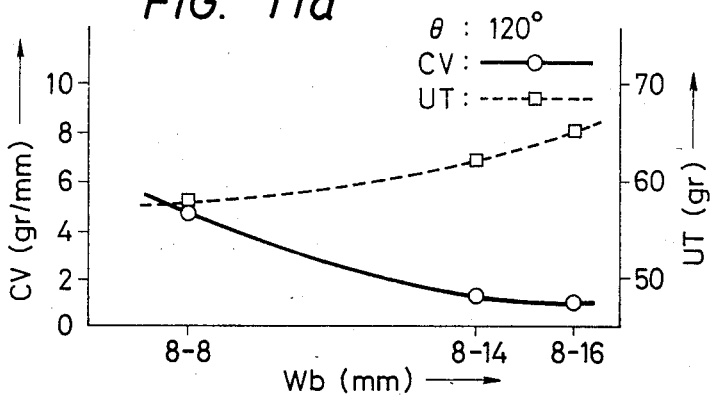
FIGS. 11*a*, 11*b* and 11*c* are graphs showing changes in untwisting tension and coefficient of variation of untwisting tension relative to the belt width respectively in the cases of 120°, 115° and 110° as belt crossing angles.
Figure 11B:
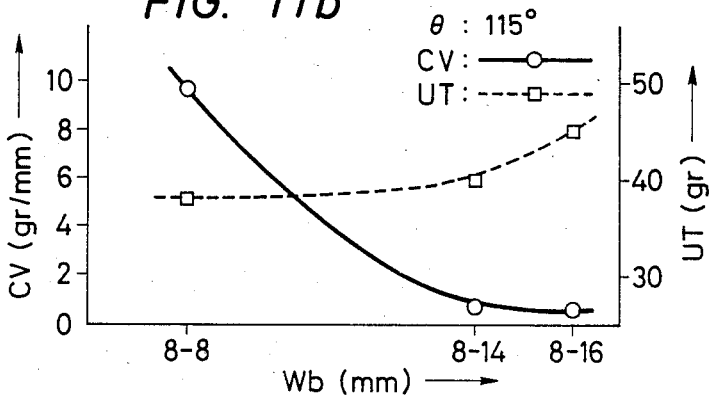
Figure 11C:
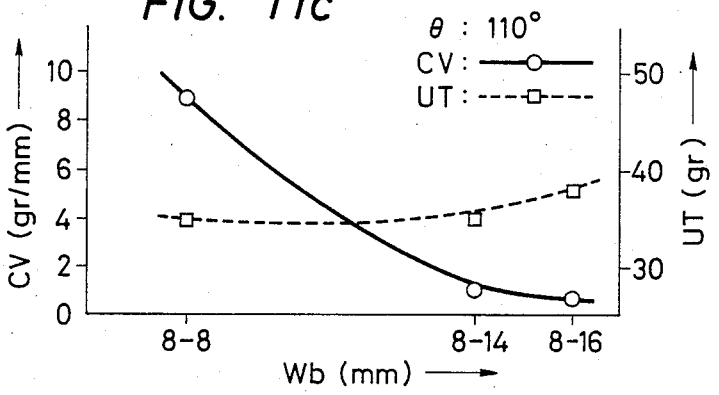

FIGS. 11*a*, 11*b* and 11*c* show changes in untwisting tension UT and in coefficient of variation of untwisting tension CV relative to such various belt widths. The "untwisting tension" referred to herein means tension acting on the yarns Y1 and Y2 just after leaving the nip area A of the belts 7 and 8. In the belt type false twister, as previously noted, both a yarn delivery force and a yarn twisting force are given simultaneously, so a small untwisting tension means a strong yarn delivery force and a sure nipping of yarn. The crossing angle ($\theta$) of both belts 7 and 8 is set at 120° in the graph of FIG. 11*a*, 115° in the graph of FIG. 11*b* and 110° in the graph of FIG. 11*c*, other conditions being the same. These graphs shows results of measurements on one yarn Y1 out of two yarns Y1 and Y2 which were simultaneously nipped by the belt type false twister 6 as shown in FIG. 3. In this case, it may be considered that both yarns Y1 and Y2 are under the same conditions. Actually, comparison between the two yarns Y1 and Y2 after false twisting showed that there was not a great difference in their characteristics. It is presumed that also in the case of using three or more yarns, about the same tendencies will be exhibited. From these graphs it is seen that the larger the width of the other belt mentioned above, the smaller the coefficient of variation of untwisting tension, but the untwisting tension becomes larger. The belt width in which both the above characteristics are considered to be relatively stable is in the range of 12 to 16 mm, most preferably 14 mm.

Figure 12A:
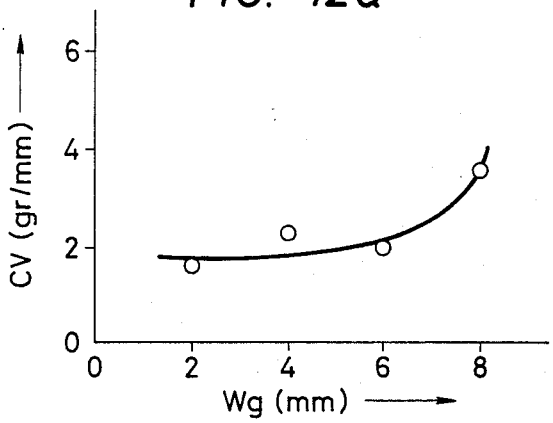
FIGS. 12*a* and 12*b* are graphs respectively showing the relation of the spacing between yarn passing holes in a second yarn guide to untwisting force and the relation thereof to coefficient of variation of untwisting tension.
Figure 12B:
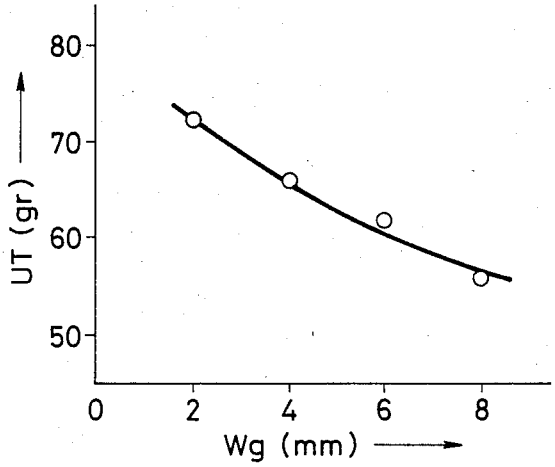

Now, results of experiments conducted while changing the spacing Wg between the yarn passing holes 25 in the second yarn guide 5 in FIG. 3 are shown in FIGS. 12*a* and 12*b*, FIG. 12*a* being a graph showing the relation between the yarn passing hole spacing Wg and the coefficient of variation CV of untwisting tension and FIG. 12*b* being a graph showing the relation between the yarn passing hole spacing Wg and untwisting tension UT. From these experimental results it is seen that a yarn passing hole spacing in the range of 4 to 6 mm, especially 5 mm, will afford the most stable characteristic.

To summarize the above test results, if the width of one belt is set at 6 to 10 mm and that of the other belt at 12 to 16 mm in false-twisting plural yarns by a single belt type false twister, it is possible to apply a stable false twisting to each yarn. The most superior processing conditions involve the width of one belt of 8 mm and that of the other belt of 14 mm, under which a yarn of good quality can be surely produced. Moreover, in the case where false twisting is performed under the above conditions, the spacing of yarns also exerts a considerable influence on the yarn characteristics. In the case of two yarns, it is preferable that the inter-yarn spacing be set at 4 to 6 mm, especially 5 mm. This can be effectively attained by setting it as the spacing Wg between the yarn passing holes 25 on the upstream side relative to the false twister, namely, in the second yarn guide 5.

By doubling and winding up as shown in FIG. 1 the yarns thus false-twisted under the above-determined conditions, the processing method involving introducing plural yarns simultaneously into a single belt type false twister, which has heretofore been infeasible, and then doubling the yarns into a single yarn, becomes feasible and permits a stable production of yarn of an extremely superior quality.

According to the present invention, as set forth hereinabove, the following effects can be expected. Firstly, since the yarn produced according to the present invention comprises a plurality of each independently false-twisted yarns, it is superior in crimping property as compared with yarn obtained from a single false-twisted yarn. Secondly, since the above plural yarns are introduced simultaneously into a single false twister, at least one textured yarn can be produced for each spindle, and thus the production efficiency does not lower. Thirdly, since the method of the present invention does not use a twisting machine or the like for doubling and twisting two starting yarns, it is not necessary to consider the torque remaining in those two yarns, and the textured yarn thereby obtained can be used for the production of various woven or knitted products.

What is claimed is:

1. A method of manufacturing a textured yarn, which method comprises the steps of:

introducing plural yarns simultaneously in a state out of contact with each other into a belt-type false twister, said twister including two crossing endless belts travelling in directions different from each other for nipping therebetween said yarns to effect false twisting of the yarns;

then exerting a compressed fluid on said plural yarns to partially intertwine the yarns; and winding up the partially intertwined yarns as a single yarn.

2. An apparatus for manufacturing a textured yarn comprising:

a plurality of yarn feed packages, each feed package comprising a strand of yarn;

a yarn heater;

a false twisting device;

a fluid processing unit for intertwining yarn with a fluid jet; and yarn guides which are arranged along and define a yarn passage, said passage extending from said yarn feed packages through said heater and said false twisting device to said fluid processing unit, said false twisting device including two crossing endless belts travelling respectively in opposite directions, certain of said yarn guides being adapted to keep the strands of yarn from said yarn packages out of contact and parallel with each other so that each strand of yarn is false twisted independently by the false twisting device.

3. An apparatus as claimed in claim 2, wherein the widths of said endless belts of the false twisting device are different from each other.

4. An apparatus as claimed in claim 2, wherein two of said yarn guides are disposed at opposite sides of the false twisting device, each of said two yarn guides having holes therethrough, the numbers of said holes in each of said two yarn guides corresponding to the number of the yarn packages, said holes being arranged so that a plurality of said strands of yarns from said packages run substantially parallel between said two yarn guides and through the false twisting device.

5. An apparatus as claimed in claim 2, wherein said fluid processing unit comprises:

a block having a groove defining a portion of said yarn passage and a fluid nozzle formed in said block;

a cover adapted to enclose the groove; and means for assembling the block and the cover integrally with each other, said groove being formed as a groove of V cross section in the block and said fluid nozzle being formed through the block to open into the groove.

6. An apparatus as claimed in claim 5, wherein the portion of said block forming the fluid nozzle is enlarged where the nozzle opens into the groove to form a generally hemispherical fluid dispersion chamber.

7. An apparatus as claimed in claim 5 or 6, wherein one of said yarn guides is disposed along said yarn passage adjacent to said fluid processing unit, said adjacent guide narrowing said yarn passage so that a plurality of said yarns which have been false twisted by said false twisting device are brought together by said adjacent yarn guide before said plural yarns are introduced into the yarn passage of the fluid processing unit.

8. A false twisting apparatus as claimed in claim 3, wherein the width of one of said belts is 6 to 10 mm and that of the other belt is 12 to 16 mm.

* * * * *